US011786780B2

(12) United States Patent
Tsai

(10) Patent No.: US 11,786,780 B2
(45) Date of Patent: Oct. 17, 2023

(54) BOUNCE TREADMILL

(71) Applicant: Fu An Wellness Technology, Inc., Taipei (TW)

(72) Inventor: Shih-Ying Tsai, Taipei (TW)

(73) Assignee: Fu An Wellness Technology, Inc., Taipei (TW)

( * ) Notice: Subject to any disclaimer, the term of this patent is extended or adjusted under 35 U.S.C. 154(b) by 0 days.

(21) Appl. No.: 17/657,450

(22) Filed: Mar. 31, 2022

(65) Prior Publication Data

US 2022/0314061 A1 Oct. 6, 2022

(30) Foreign Application Priority Data

Apr. 6, 2021 (TW) ..... 110112420

(51) Int. Cl.
*A63B 22/02* (2006.01)

(52) U.S. Cl.
CPC ..... *A63B 22/0207* (2015.10); *A63B 22/0235* (2013.01); *A63B 22/0285* (2013.01)

(58) Field of Classification Search
CPC ..... A63B 22/0285; A63B 22/02–0228; A63B 22/0235–0264; A63B 2022/0271–0278
See application file for complete search history.

(56) References Cited

U.S. PATENT DOCUMENTS 4,334,676 A * 6/1982 Schonenberger ..... A63B 22/02 482/54
4,548,405 A * 10/1985 Lee ..... A63B 22/02 482/54
4,614,337 A * 9/1986 Schonenberger ..... A63B 22/02 482/54
4,938,473 A * 7/1990 Lee ..... A63B 22/0214 482/54
6,042,514 A * 3/2000 Abelbeck ..... A63B 22/02 482/54
8,721,504 B2 * 5/2014 Wang ..... A63B 22/02 482/54
9,675,840 B2 * 6/2017 Walstead, Jr. ..... A63B 22/0207
10,010,748 B1 * 7/2018 Weinstein ..... A63B 22/0285
10,478,666 B2 * 11/2019 Yoo ..... A63B 22/0214
11,007,404 B2 * 5/2021 Yoo ..... A63B 22/0285
11,148,005 B2 * 10/2021 Astilean ..... A63B 24/0087
(Continued)

FOREIGN PATENT DOCUMENTS

NO 315458 B1 * 9/2003 ..... A63B 22/02

*Primary Examiner* — Loan B Jimenez
*Assistant Examiner* — Kathleen M Fisk
(74) *Attorney, Agent, or Firm* — Wang Law Firm, Inc.

(57) ABSTRACT

A bounce treadmill is disclosed, with the main feature in that an annular running belt composed of a plurality of running belt units is arranged on a base, and each running belt unit at least comprises: a fixed seat, an elastic element and a running belt piece; wherein, two opposite ends of the fixed seat are respectively fixed to a pair of transmission elements arranged on the base, two ends of the elastic element are respectively fixed to the opposite ends of the fixed seat, two ends of the running belt piece are respectively fixed to the two opposite ends of the fixed seat, and the elastic element is connected to the bottom of the running belt piece, whereby when the running belt piece is bent and deformed under the weight to create a downward force, absorbed by the elastic element and an upward elastic force is provided.

10 Claims, 9 Drawing Sheets

(56) References Cited

U.S. PATENT DOCUMENTS

| | | | | |
|---|---|---|---|---|
| 2018/0104534 | A1* | 4/2018 | Erkelenz | A63B 22/0235 |
| 2020/0094105 | A1* | 3/2020 | Kueker | A63B 22/0221 |
| 2020/0129837 | A1* | 4/2020 | Liao | A63B 24/0087 |
| 2020/0147447 | A1* | 5/2020 | Chiu | A63B 21/015 |
| 2022/0096894 | A1* | 3/2022 | Astilean | B62K 5/00 |
| 2022/0314061 | A1* | 10/2022 | Tsai | A63B 22/0207 |

* cited by examiner

BOUNCE TREADMILL

CROSS-REFERENCE TO RELATED APPLICATION

This application claims the priority of Taiwanese patent application No. 110112420, filed on Apr. 6, 2021, which is incorporated herewith by reference.

BACKGROUND OF THE INVENTION

1. Field of the Invention

The present invention relates generally to a sports and fitness equipment, and more particularly, to a bounce treadmill with a bouncing function while running.

2. Prior Art

For those who like to exercise and practice fitness, treadmills are generally popular because they are not affected by the outdoor environment and climate. The traditional treadmill is mainly equipped with a set of driving wheels and a set of driven wheels at both ends of the base, and then a running belt is passed around the driving wheels and the driven wheels to form a loop, and the upper side of the loop-shaped running belt is located above the platform of the base. The body weight acting on the upper side of the running belt is supported by the platform; the driving wheel is driven by a motor, so as to operate with the driven wheel to drive the running belt to rotate cyclically.

Since the running belt of the traditional treadmill is relatively rigid, in order to improve the comfort of running on the treadmill, Taiwan Patent No. M583310 provides a treadmill with a cushioning effect, which includes a base, a cushioning set and a treadmill, and the base has a fixed part and a force-receiving part arranged at intervals. The cushioning set includes an elastic cushioning block, a fixed seat, a rotating seat and a support plate. The elastic cushioning block is arranged on the force-receiving part, the fixed seat is fixed on the fixed part, and the rotating seat is fixed on one end of the treadmill. The two ends of the support plate are respectively pivoted on the fixed seat and the rotating seat. The treadmill rotates relative to the support plate with the rotating seat, and keeps the support plate in contact with the elastic cushioning block, so that the treadmill can switch between a folded position and a use position relative to the base, thereby, providing a cushioning effect when the user runs on the treadmill.

SUMMARY OF THE INVENTION

The object of the present invention is to provide a bounce treadmill that allows a user to step on the running belt of the treadmill and run while having a bouncing function.

The present invention provides a bounce treadmill, comprising: a base with a drive mechanism disposed between opposite two side walls, the drive mechanism being driven by a motor to drive a pair of transmission elements to rotate cyclically in the longitudinal direction of the base; and a plurality of running belt units, connected between the pair of transmission elements, and the plurality of running belt units being disposed along surrounding direction of the transmission elements and separated from each other, wherein each of the running belt units at least including: a fixed seat, with two opposite ends being respectively fixed to the pair of transmission elements; at least one elastic element, with two ends being respectively fixed to the two opposite ends of the fixed seat; and a running belt piece, with two ends being respectively fixed to the two opposite ends of the fixed seat and a lower surface of the running belt piece being connected with the elastic element. With the bounce treadmill, when a user steps on the running belt piece to deform the running belt piece, the elastic element provides an upward elastic force to form a buffering effect, so that the running belt has a bouncing function at the same time.

Preferably, the elastic element is an elastic cable or a flat elastic strip, and so on; the running belt piece is supported in the longitudinal direction by the elastic cable or the flat elastic strip, so as to support the running belt piece to bend and deform downward in the longitudinal direction.

Preferably, at least one limiting structure is formed on the lower surface of the running belt piece, and the elastic cable or the flat elastic strip is limited by the limiting structure. Thereby, the cable supporting under the running belt piece will not be displaced form the running belt piece.

In an embodiment, the limiting structure is a groove formed on the lower surface of the running belt piece, and the elastic cable or the flat elastic strip is accommodated in the groove; thereby the groove limits the lateral displacement of the elastic cable or the flat elastic strap.

In an embodiment, the limiting structure is formed as a through hole penetrating opposite sides of the running belt piece, and the elastic cable or the flat elastic strip passes through the through hole; thereby the through hole limits the displacement of the elastic cable or the flat elastic strap in all directions.

Preferably, the fixing seat has a beam frame, and two ends of the beam frame are respectively provided with a convex seat, upper surfaces of the convex seats are higher than upper surface of the beam frame, and the two ends of the elastic element are respectively fixed to the convex seats to keep a space between the lower surface of the elastic element and the upper surface of the beam frame. With this space, when the running belt piece is subjected to a stepping force, the deformation amount of the elastic element being bent and deformed downward can be accommodated.

Preferably, along the surrounding direction of the transmission element, corresponding sides of two adjacent running belt pieces are respectively formed with surfaces of complementary shapes. With the surfaces of the corresponding sides of the two adjacent running belt pieces having complementary shapes, the two running belt pieces can support each other to avoid a gap when the two running belt pieces are simultaneously subjected to a downward force, thereby preventing the user's foot from sinking into between the two running belt pieces.

In an embodiment, the surfaces of the complementary shapes of the corresponding sides of the two adjacent running belt pieces are inclined surfaces.

In another embodiment, the surfaces of the complementary shapes of the corresponding sides of the two adjacent running belt pieces are step surfaces.

Preferably, the driving mechanism further comprises a pair of driving wheels and a pair of driven wheels, the pair of driving wheels being disposed between two opposite side walls at one end of the base, and the pair of driven wheels being disposed on the opposite sides of the base between two opposite side walls at the other end, the transmission element surrounding the pair of driving wheels and the pair of driven wheels, and the driving wheels being connected to the driving motor.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
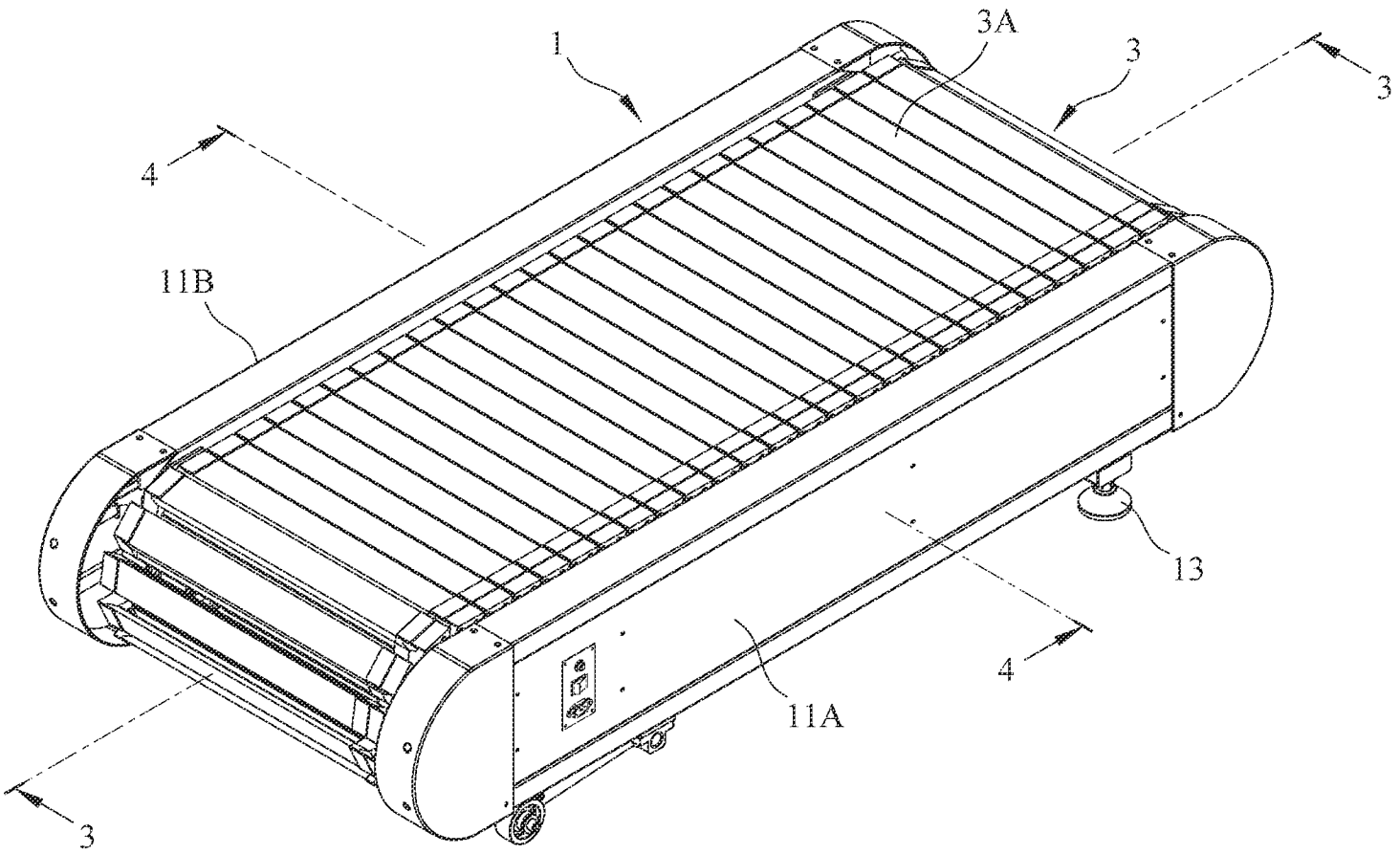
FIG. 1 is a schematic perspective view showing the appearance of the present invention.

The accompanying drawings are included to provide a further understanding of the invention, and are incorporated in and constitute a part of this specification. The drawings illustrate embodiments of the invention and, together with the description, serve to explain the principles of the invention.

As shown in FIGS. 1 to 4, the bounce treadmill provided by the present invention comprises: a base 1, a drive mechanism 2, and a running belt 3 composed of a plurality of running belt units 3A; wherein, the base 1 has a first side wall 11A and a second side wall 11B disposed on opposite sides. A plurality of beams 12 are disposed between the first and second side walls 11A and 11B to connect the two side walls. The connection method preferably uses mechanical elements such as screws or bolts for locking to form a stable base 1. Wherein, the bottom of the first side wall 11A and the second side wall 11B are also provided with feet 13 for supporting the base 1, so that the bottom of the base 1 and the ground maintain a proper space.

Figure 2:
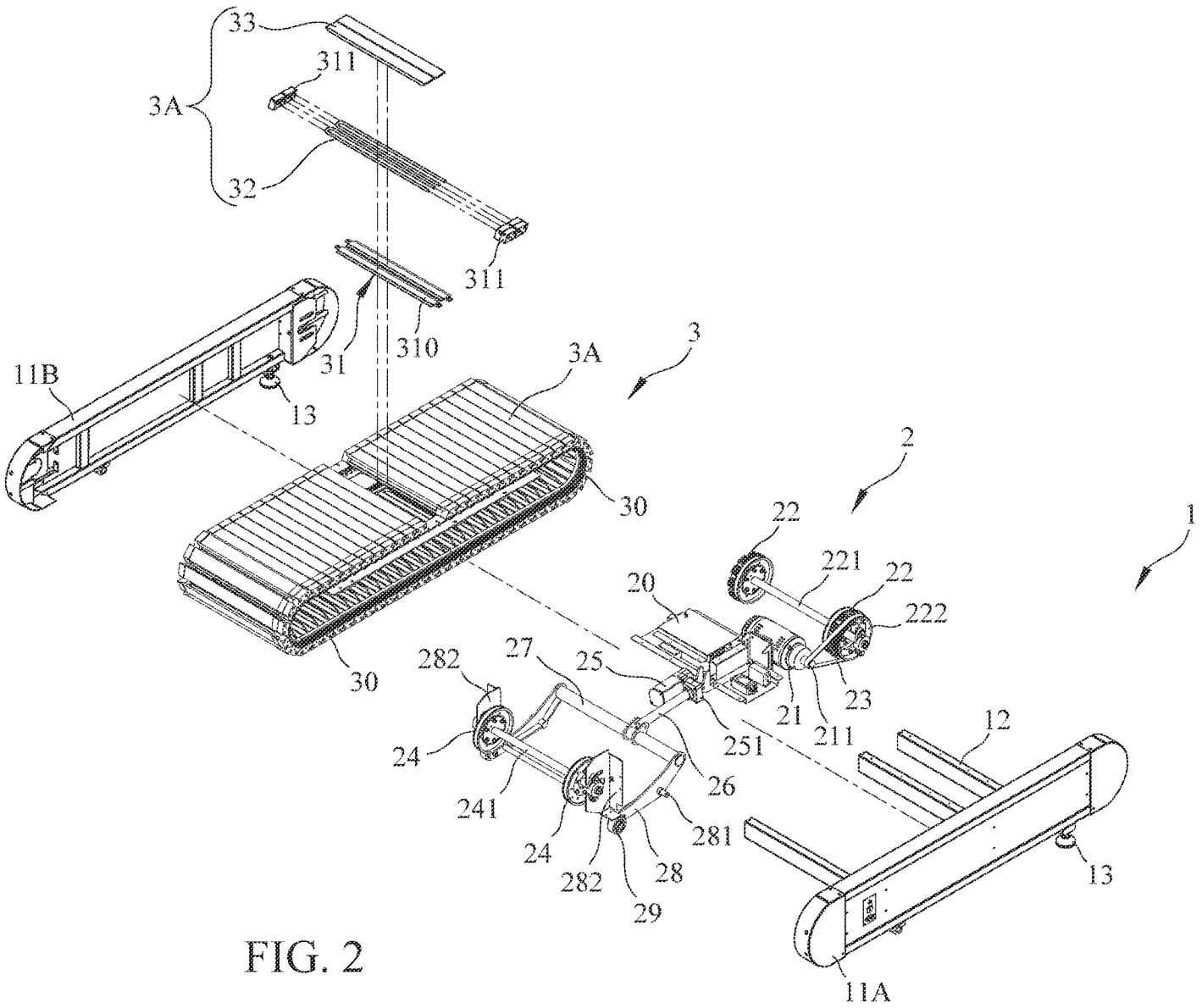
FIG. 2 is a perspective exploded view showing the assembly relationship of the key components of the present invention.

The drive mechanism 2 is disposed between the first and second side walls 11A, 11B of the base 1, and includes at least a control unit 20, a pair of driving wheels 22, a pair of driven wheels 24, and a first motor 21. As shown in FIG. 2, the pair of driving wheels 22 are coaxially connected by a driving shaft 221 and are arranged between the first and second side walls 11A and 11B at one end of the base 1; the pair of driven wheels 24 are coaxially connected by a driven shaft 241 disposed between the first and second side walls 11A and 11B at the opposite end of the base 1. A preferred embodiment of the driving wheels 22 and the driven wheels 24 in the present invention are timing wheels, but the present invention is not limited thereto.

The drive mechanism 2 further comprises a first motor 21, and the first motor 21 is electrically connected to the control unit 20; a main shaft of the first motor 21 is provided with a driving pulley 211, and one of the pair of driving wheels 22 is coaxially disposed with a driven pulley 222. The driving pulley 211 and the driven pulley 222 are connected by a belt 23. Therefore, the user can control the operation of the first motor 21 by operating the control unit 20, so as to control the driving wheels 22 to rotate through the driving pulley 211, the belt 23, and the driven pulley 222.

Moreover, the drive mechanism 2 further comprises a second motor 25, which is mechanically connected to a reducer 251, which is mechanically connected to a connecting rod 26. One end of the connecting rod 26 is pivotally connected to a shaft rod 27, and the opposite two ends of the shaft rod 27 are respectively disposed with one end of a swing arm 28 fixedly attached. A roller 29 is movably disposed at the opposite end of the swing arm 28. Between the two ends of each swing arm 28, a rotating shaft 281 is rotatably connected to the first side wall 11A and the second side wall 11B. As such, when the second motor 25 is controlled to run in the forward direction by the control unit 20, the connecting rod 26 can be controlled to extend, so as to drive the swing arm 28 to swing upward through the shaft rod 27, or when the second motor 25 is controlled to run in the reverse direction, the connecting rod 26 can be controlled to be shortened, so as to drive the swing arm 28 to swing downward through the shaft rod 27. When the end of the connecting shaft 27 with the swing arm 28 swings upward, the end with the roller 29 swings downward. Since the feet 13 are supported by the ground, the entire base is supported by the ground when the roller 29 swings downward to lift up to adjust and expand the inclination angle of the base 1. Conversely, when the end of the connecting shaft 27 with the swing arm 28 swings downward, the end with the roller 29 swings upward to adjust and reduce the inclination angle of the entire base 1. In the preferred embodiment of the present invention, the aforementioned pair of driven wheels 24 are disposed and fixed between the vertical plates 282 of the two swing arms 28, therefore, when the swing arms 28 swing up or down, they can drive the pair of driven wheels 24 to move up or down.

The running belt 3 is an element that provides the contact to the sole of the feet of the user to run. In the present invention, the running belt 3 is composed of a plurality of running belt units 3A and a pair of closed annular transmission elements 30. The plurality of running belt units 3A are arranged along the surrounding direction of the transmission element 30 and are separated from each other. Specifically, the transmission elements 30 are used to match the timing belt connecting the driving wheel 22 and the driven wheel 24.

Figure 3:
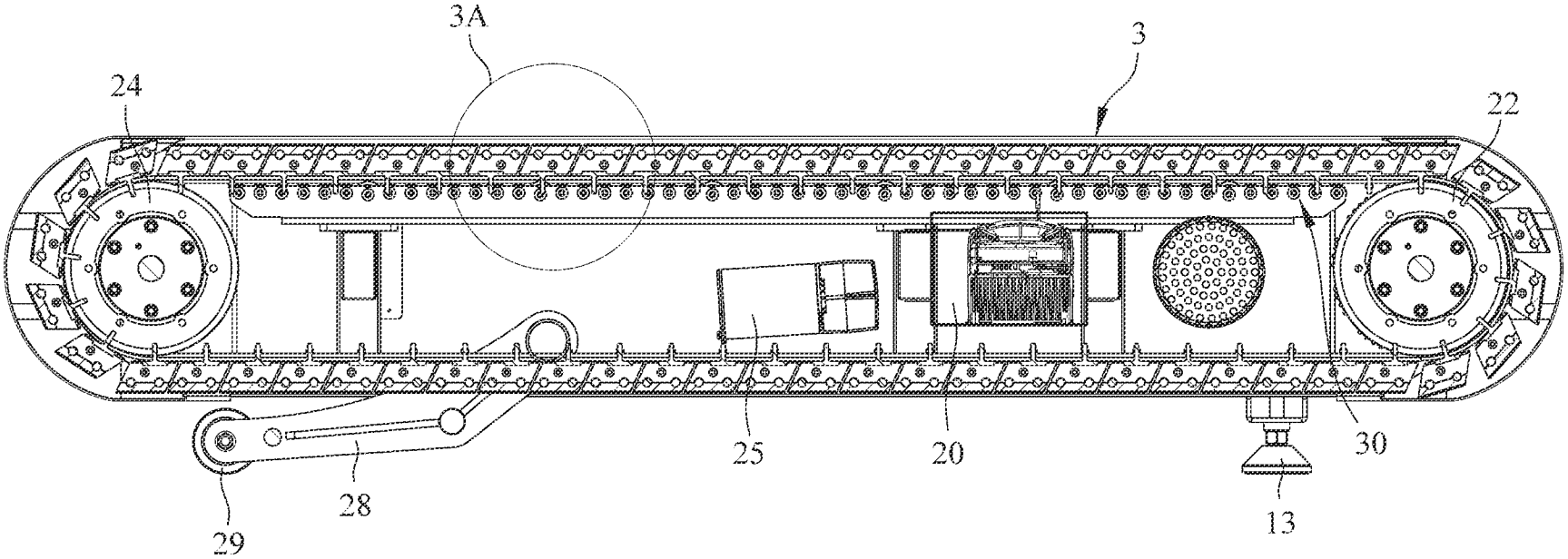
FIG. 3 is a planar cross-sectional view along the section line 3-3 of FIG. 1.
Figure 3A:
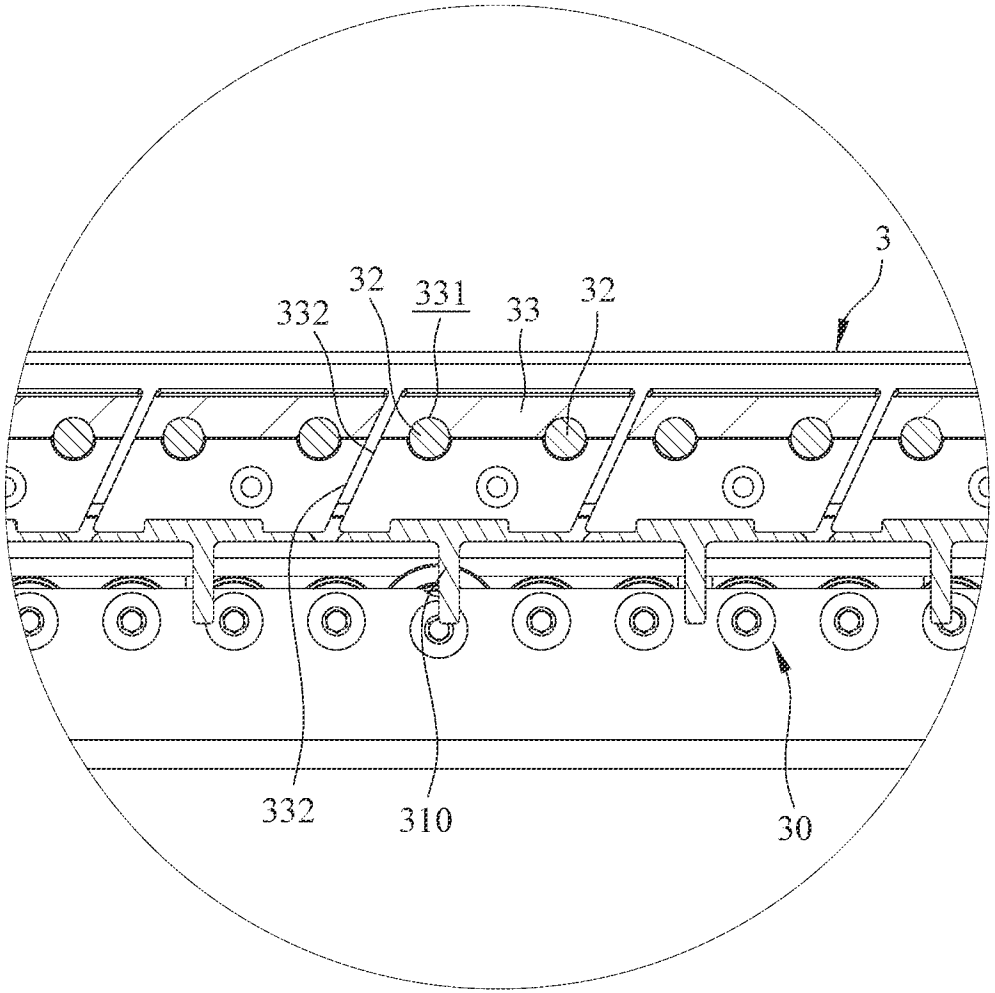
FIG. 3A is a partial enlarged view of the area 3A of FIG. 3.
Figure 4:
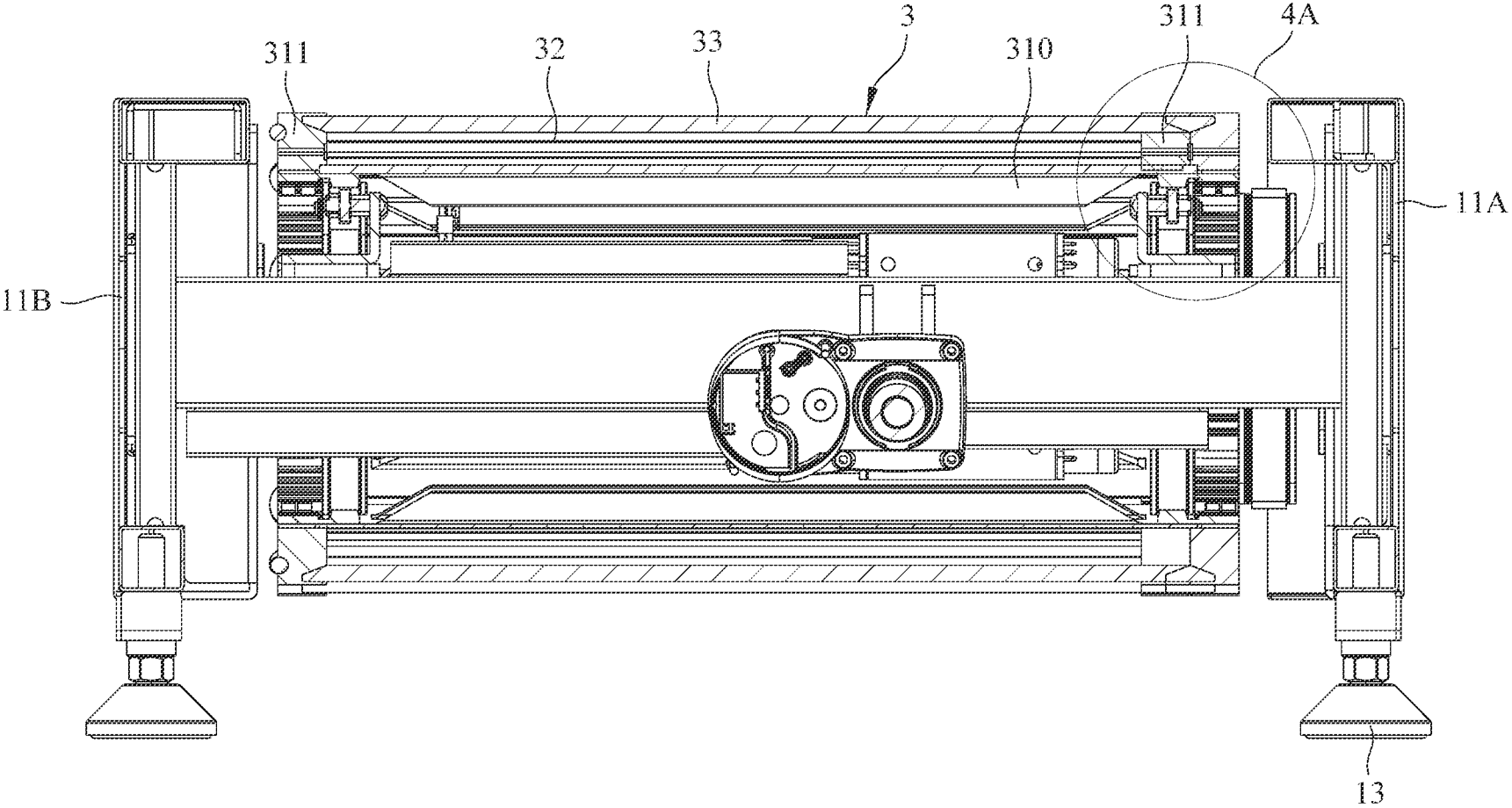
FIG. 4 is a planar cross-sectional view along the section line 4-4 of FIG. 1.
Figure 4A:
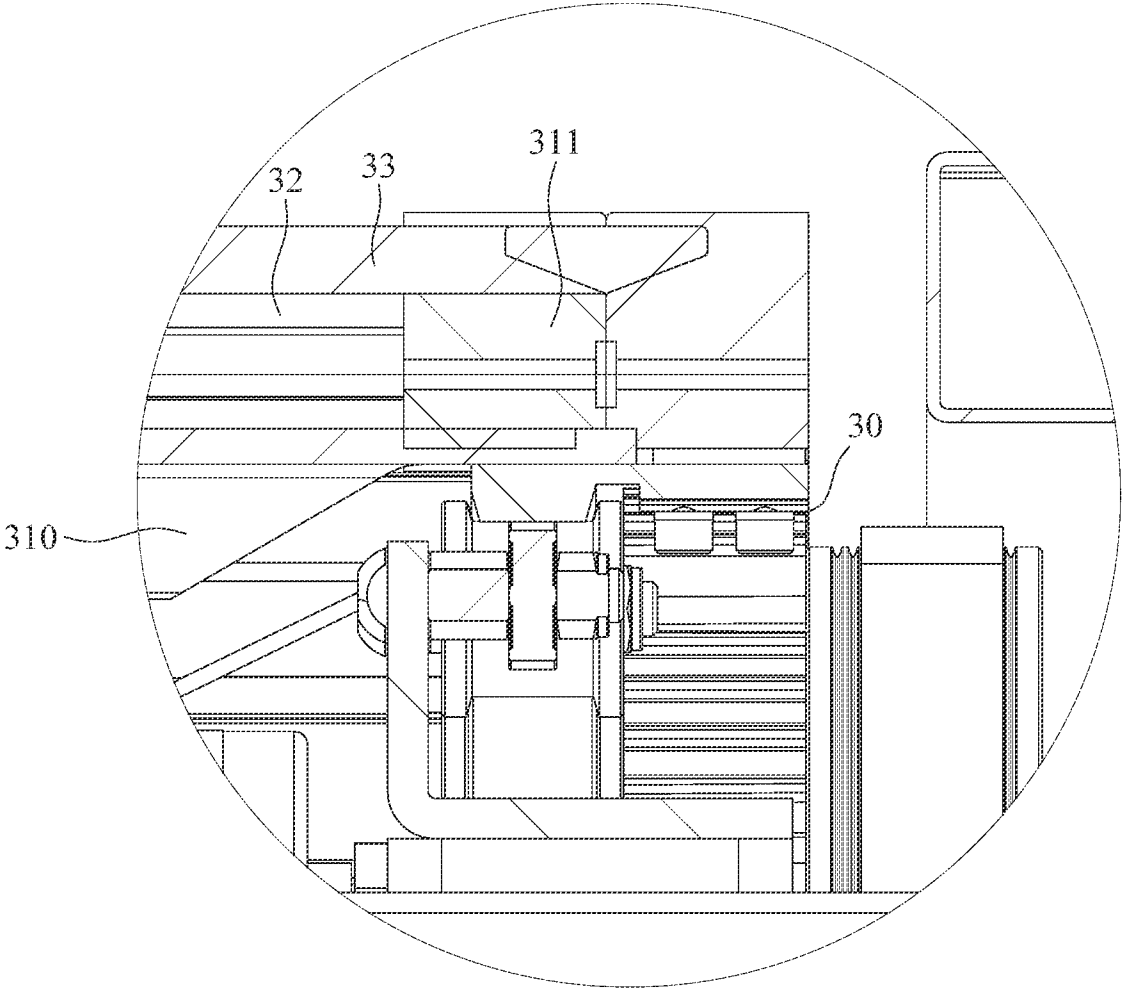
FIG. 4A is a partial enlarged view of the area 4A of FIG. 4.

The running belt unit 3A includes a fixed seat 31, at least one elastic element 32 and a running belt piece 33; wherein, the fixed seat 31 is formed to have a beam frame 310, and two opposite ends of the beam frame 310 are respectively disposed with a convex seat 311, and the upper surface of the convex seat 311 is higher than the upper surface of the beam frame 310, in other words, a concave space is formed above the beam frame 310 between the two convex seats 311. The upper surfaces of the two convex seats 311 are respectively fixed to the two transmission elements 30. Both ends of the elastic element 32 are respectively fixed to the convex seats 311 at opposite ends of the fixed base 31. The two opposite ends of the running belt piece 33 are also respectively fixed to the convex seats 311 at the opposite ends of the fixed base 31, and the lower surface of the running belt piece 33 is connected to the elastic element 32. Specifically, the elastic element 32 can be an elastic cable or a flat elastic strip. When both ends of the elastic cable or flat elastic strip are fixed to the convex seats 311 at both ends, the elastic cable is suspended between the two convex seats 311 above the beam frame 310; and, in order to prevent relative displacement when the elastic element 32 in the form of a cable or a strip contacts the lower surface of the running belt piece 33, the present invention preferably forms at least a groove 331 on the lower surface of the running belt piece 33, and the elastic cable is accommodated in the groove 331, as shown in FIG. 3A. Alternatively, a transverse through hole can be formed in the running belt piece 33, and the elastic element 32 in the form of a cable or a strip can pass through the through hole Then, both ends of the elastic element 32 are fixed to the convex seats 311, as shown in FIG. 4. In the embodiment shown in FIG. 2, the elastic element 32 can bend a cable into a U shape and then fix the open end and the closed end of the U-shaped cable to the convex seat 311 respectively.

Figure 5:
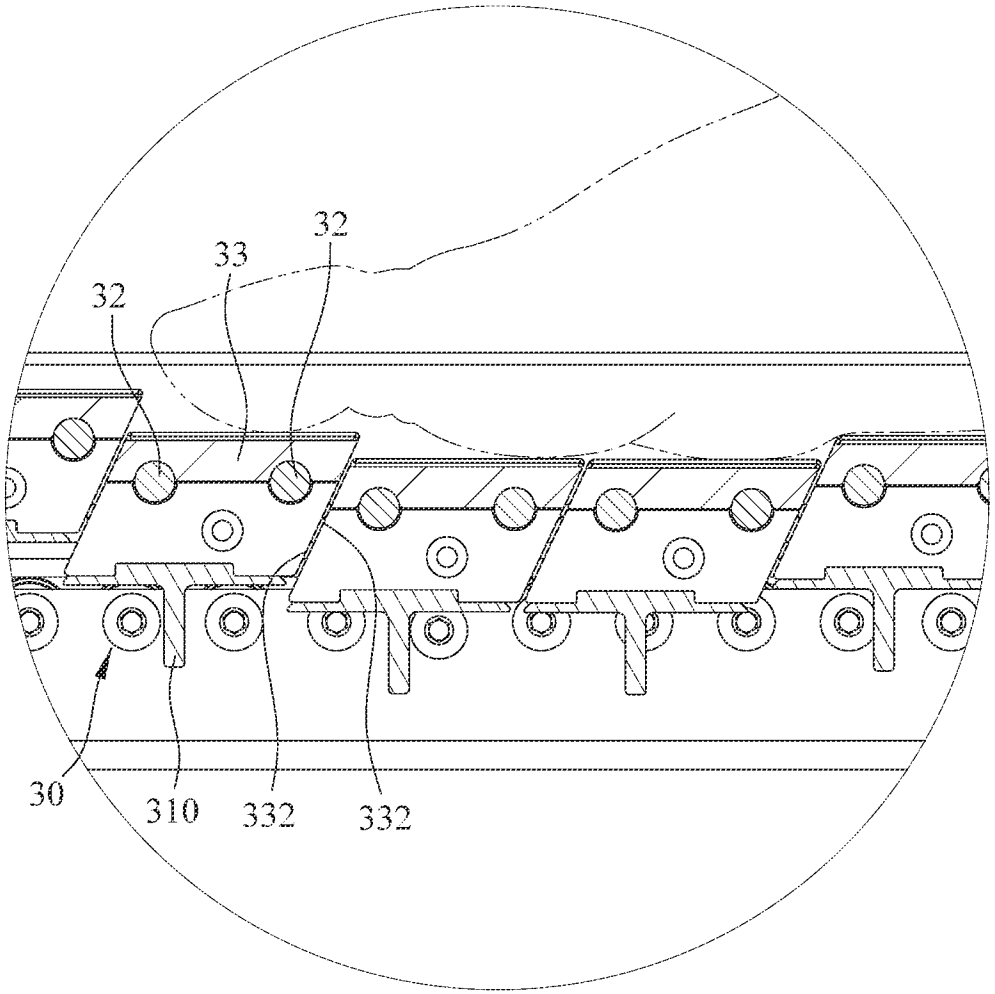
FIG. 5 is a schematic view showing the state of deformation when two adjacent running belt pieces shown in FIG. 3A are subjected to a downward force.

The running belt 3 formed by the aforementioned running belt unit 3A and the transmission element 30 can surround the driving wheel 22 and the driven wheel 24 when mounted on the base 1 and matched with the driving mechanism 2 to be driven for circular rotation. When the user steps on the running belt piece 3, the weight of the human body will cause the running belt piece 33 to bend downward and deform, as shown in FIG. 5. The downward force of the running belt piece 3 is absorbed by the elastic element 32 and a downward elasticity is provided by the elastic element 32, so that the running belt piece 3 has a bouncing effect.

Figure 6:
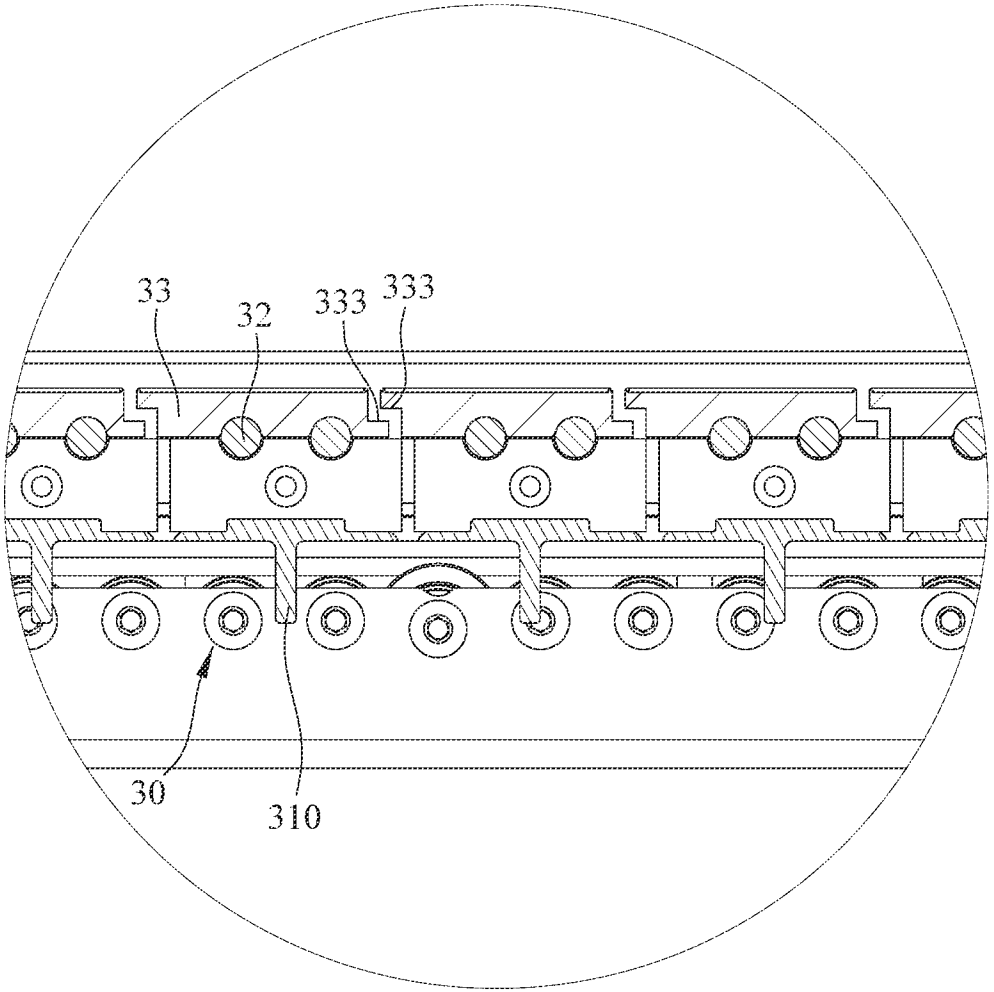
FIG. 6 is the partial planar enlarged view showing that the corresponding sides of the two adjacent running belt pieces of the present invention have complementary shapes.
Figure 6A:
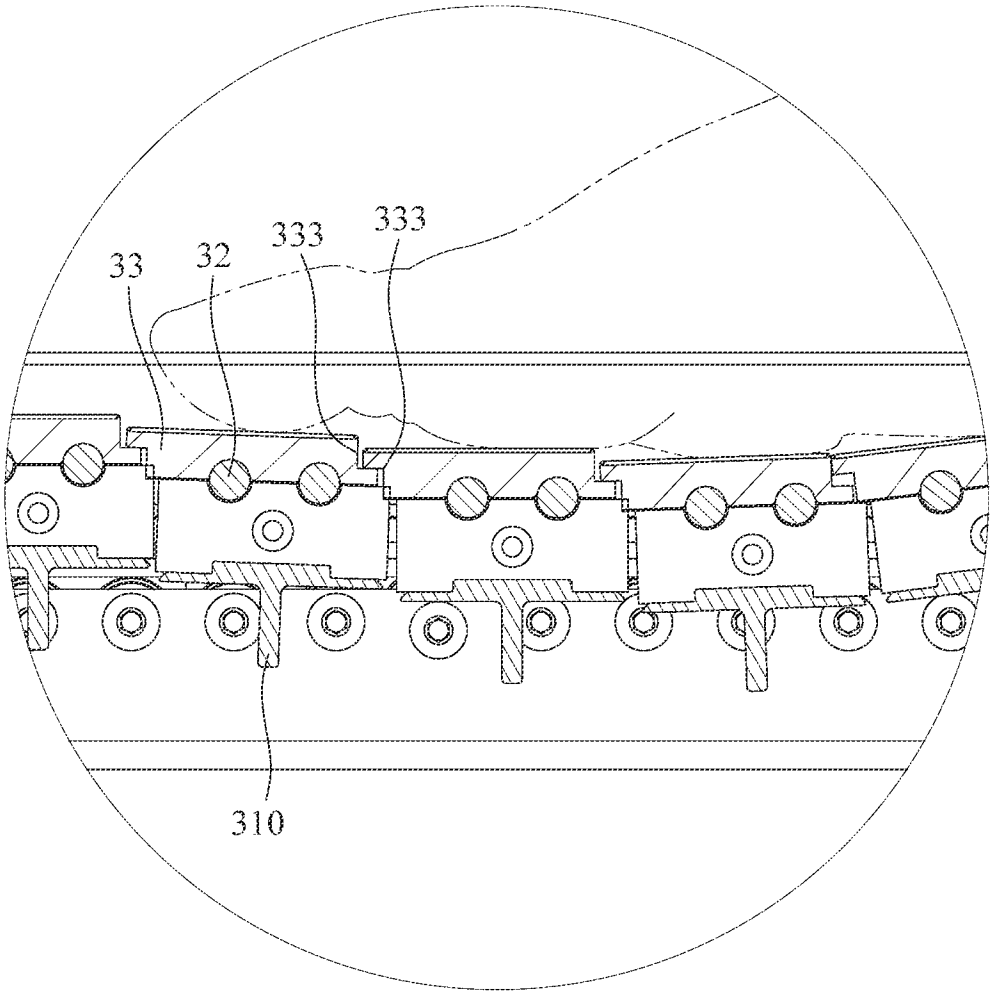
FIG. 6A is a schematic view showing the state of deformation when two adjacent running belt pieces shown in FIG. 6 are subjected to a downward force.

On the other hand, in order to prevent a gap from occurring between the two adjacent running belt pieces 33 when the user from stepping on the running belt piece 33 and causing the foot to sink into the gap, the present invention preferably will from surfaces of complementary shapes on the corresponding sides of each other of two adjacent running belt pieces 33 along the surrounding circumferential direction of the transmission element 30. For example, the surface of the complementary shape can be an inclined surface 332, as shown in FIG. 5. When the user steps on the running belt piece 33 to cause the two adjacent running belt pieces 33 to bend and sag downward, the corresponding sides of the two adjacent running belt pieces 33 can be mutually supported by the inclined surface 332 to avoid a gap, as shown in FIG. 5. Alternatively, the surface of the complementary shape may be a step surface 333, as shown in FIG. 6. When the user steps on the running belt piece 33 to cause the adjacent two running belt pieces 33 to bend and sag downward, the corresponding sides of the two running belt pieces 33 can be mutually supported by the step surface 333 to avoid gaps, as shown in FIG. 6A.

The present invention, by the bounce treadmill of the aforementioned structure, not only has the function of a treadmill, but also provides a bouncing function while running, so that the exercise modes and effects are more diverse.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A bounce treadmill, comprising:

a base, with a drive mechanism disposed between two opposite side walls, the drive mechanism being driven by a motor to drive a pair of transmission elements to rotate cyclically in the longitudinal direction of the base;

a plurality of running belt units, connected between the pair of transmission elements, and the plurality of running belt units being disposed along a surrounding direction of the transmission elements and separated from each other, wherein each of the running belt units at least including:

a fixed seat, with two opposite ends being respectively fixed to the pair of transmission elements;

at least one elastic element, with two ends being respectively fixed to the two opposite ends of the fixed seat; and a running belt piece, with two ends being respectively fixed to the two opposite ends of the fixed seat and a lower surface of the running belt piece being connected with the at least one elastic element.

2. The bounce treadmill according to claim 1, wherein the at least one elastic element of each of the plurality of running belt units is an elastic cable or a flat elastic strip.

3. The bounce treadmill according to claim 2, wherein at least one limiting structure is formed on the lower surface of the running belt piece of each of the plurality of running belt units, and the respective elastic cable or flat elastic strip is limited by the at least one limiting structure.

4. The bounce treadmill according to claim 3, wherein the at least one limiting structure is a groove formed on the lower surface of the respective running belt piece of each of the plurality of running belt units, and the respective elastic cable or flat elastic strip is accommodated in the groove.

5. The bounce treadmill according to claim 3, wherein the at least one limiting structure is formed as a through hole penetrating opposite sides of the respective running belt piece of each of the plurality of running belt units, and the respective elastic cable or flat elastic strip passes through the through hole.

6. The bounce treadmill according to claim 1, wherein corresponding sides of two adjacent running belt pieces along the surrounding direction of the transmission element are respectively formed with surfaces of complementary shapes.

7. The bounce treadmill according to claim 6, wherein the surfaces of the complementary shapes of the corresponding sides of the two adjacent running belt pieces are inclined surfaces.

8. The bounce treadmill according to claim 6, wherein the surfaces of the complementary shapes of the corresponding sides of the two adjacent running belt pieces are step surfaces.

9. The bounce treadmill according to claim 6, wherein the drive mechanism further comprises a pair of driving wheels and a pair of driven wheels, the pair of driving wheels being disposed between the two opposite side walls at one end of the base, and the pair of driven wheels being disposed between the two opposite side walls at the other end of the base, the pair of transmission elements surrounding the pair of driving wheels and the pair of driven wheels, and the driving wheels being connected to the motor.

10. The bounce treadmill according to claim 1, wherein the fixed seat of each of the plurality of running belt units has a beam frame, and two ends of the beam frame are respectively provided with a convex seat, upper surfaces of the convex seats are higher than an upper surface of the beam frame, and the two ends of the respective at least one elastic element are respectively fixed to the convex seats to keep a space between a lower surface of the at least one elastic element and the upper surface of the beam frame.

* * * * *